US009115565B1

(12) United States Patent
Richards et al.

(10) Patent No.: US 9,115,565 B1
(45) Date of Patent: Aug. 25, 2015

(54) GRAVEL PACK CIRCULATING SLEEVE WITH LOCKING FEATURES

(71) Applicant: Halliburton Energy Services, Inc., Houston, TX (US)

(72) Inventors: William Mark Richards, Flower Mound, TX (US); Christopher Robert Delzell, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/382,780

(22) PCT Filed: Oct. 29, 2013

(86) PCT No.: PCT/US2013/067260

§ 371 (c)(1),
(2) Date: Sep. 4, 2014

(87) PCT Pub. No.: WO2015/065335

PCT Pub. Date: May 7, 2015

(51) Int. Cl.

| | |
|---|---|
| ***E21B 34/00*** | (2006.01) |
| ***E21B 34/06*** | (2006.01) |
| ***E21B 34/14*** | (2006.01) |

(Continued)

(52) U.S. Cl.
CPC ..... *E21B 34/14* (2013.01); *E21B 34/102* (2013.01); *E21B 43/04* (2013.01); *E21B 43/045* (2013.01); *E21B 2034/007* (2013.01)

(58) Field of Classification Search
CPC ..... E21B 34/102; E21B 2034/005; E21B 2034/002; E21B 34/14; E21B 34/103; E21B 34/10; E21B 34/08; E21B 21/10; E21B 34/108; E21B 34/063; E21B 21/103; E21B 2034/007; E21B 43/04; E21B 43/045
See application file for complete search history.

(56) References Cited

U.S. PATENT DOCUMENTS

| | | | | |
|---|---|---|---|---|
| 4,574,889 | A * | 3/1986 | Pringle | 166/386 |
| 4,928,772 | A * | 5/1990 | Hopmann | 166/386 |
| 5,549,161 | A * | 8/1996 | Gomez et al. | 166/255.1 |
| 5,931,229 | A | 8/1999 | Lehr et al. | |

(Continued)

FOREIGN PATENT DOCUMENTS

WO 2015065335 A1 5/2015

OTHER PUBLICATIONS

International Search Report and Written Opinion for PCT/US2013/067260 dated Jul. 24, 2014.

*Primary Examiner* — Kenneth L Thompson
*Assistant Examiner* — Michael Wills, III
(74) *Attorney, Agent, or Firm* — McDermott Will & Emery LLP; Scott Richardson

(57) ABSTRACT

Disclosed are circulating sleeves that can be opened and closed and permanently closed. A disclosed completion system includes a completion string having a circulating sleeve movably arranged therein, the circulating sleeve having a locking profile defined on an outer radial surface thereof and a shifting profile defined on an inner radial surface thereof, a service tool configured to be arranged at least partially within the completion string and including a shifting tool having one or more shifting keys configured to mate with the shifting profile, wherein, when the shifting keys locate and mate with the shifting profile, an axial load applied on the service tool axially moves the circulating sleeve, and a release shoulder assembly arranged within the completion string and comprising a release shoulder that defines a channel configured to receive a locking mechanism occluded within the channel until the release shoulder is moved axially.

21 Claims, 7 Drawing Sheets

(51) Int. Cl.
*E21B 43/04* (2006.01)
*E21B 34/10* (2006.01)

(56) References Cited

U.S. PATENT DOCUMENTS 5,975,205 A 11/1999 Carisella
6,364,017 B1 4/2002 Stout et al.
7,556,102 B2 * 7/2009 Gomez ..... 166/373
7,712,538 B2 * 5/2010 Fay ..... 166/332.4
8,316,943 B2 11/2012 Fagley, IV et al.
8,857,518 B1 * 10/2014 Tips et al. ..... 166/313
8,870,153 B2 * 10/2014 Ross ..... 251/63.6
2005/0126787 A1 * 6/2005 Gomez ..... 166/319

* cited by examiner

GRAVEL PACK CIRCULATING SLEEVE WITH LOCKING FEATURES

BACKGROUND

The present disclosure relates to the treatment of subterranean production intervals and, more particularly, to gravel packing circulating sleeves that can be opened and closed and permanently closed.

In the oil and gas industry, particulate materials such as sand and other wellbore debris are often produced to the surface during the extraction of hydrocarbons from a well that traverses unconsolidated or loosely consolidated subterranean formations. Producing such particulate matter can cause abrasive wear to components within the well, such as tubing, pumps, and valves, and can sometimes partially or fully clog the well creating the need for an expensive workover operation. Also, if the particulate matter is produced to the surface, it must be removed from the extracted hydrocarbons by various processing equipment at the surface.

To prevent the production of such particulate material to the surface, unconsolidated or loosely consolidated production intervals in the well are often gravel packed. In a typical gravel pack operation, a completion string including a packer, a circulation valve, a fluid loss control device and one or more sand control screens, is lowered into the wellbore to a position proximate the desired production interval. A service tool is then positioned within the completion string and a fluid slurry that includes a liquid carrier and a particulate material (i.e., gravel) is then pumped through the circulation valve and into the well annulus formed between the sand control screens and the perforated well casing or open hole production zone. The liquid carrier either flows into the adjacent formation or returns to the surface by flowing through the sand control screens, or both. In either case, the gravel is deposited around the sand control screens to form a gravel pack, which is highly permeable to the flow of hydrocarbon fluids but simultaneously blocks the flow of the particulate material often carried in the hydrocarbon fluids. As such, gravel packs can successfully prevent the problems associated with the production of particulate materials from the formation.

During the gravel packing operation, the service tool is often moved between various positions with respect to the completion string. For instance, the service tool typically has one or more shifting tools that can be used to move sliding sleeves associated with the completion string between open and closed configurations. Opening a circulating sleeve arranged in the circulation valve, for example, may expose one or more corresponding circulation ports that place the interior of the service tool in fluid communication with an annulus defined between the completion string and an adjacent formation. Upon removing the service tool from the completion string, it is often required to move various sleeves to their corresponding closed positions. In some cases, a well operator may require or otherwise desire that the circulating sleeve be permanently locked in a closed position so that fluids from the annulus are prevented from entering the completion via the circulation ports.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to the treatment of subterranean production intervals and, more particularly, to gravel packing circulating sleeves that can be opened and closed and permanently closed.

The shifting tools disclosed herein allow an operator to open and close circulating sleeves multiple times during a single run-in into a wellbore, and ultimately lock the circulating sleeves in a permanently closed position when desired. Release shoulders are described that hide corresponding locking mechanisms that, when exposed after shifting the particular release shoulder, are able to engage a locking profile defined on a corresponding circulating sleeve and thereby secure the circulating sleeve in its axially closed position. Various configurations of shifting tools, including various designs of shifting keys, are used to interact and otherwise mate with corresponding shifting profiles defined on the circulating sleeves. Once a particular shifting key design successfully locates a corresponding shifting profile, the shifting tool is able to axially move the circulating sleeve, and potentially lock the circulating sleeve in a permanently closed position. Advantageously, there is no way to accidently place a circulating sleeve in a permanently closed position without using a correspondingly designed shifting tool.

Figure 1:
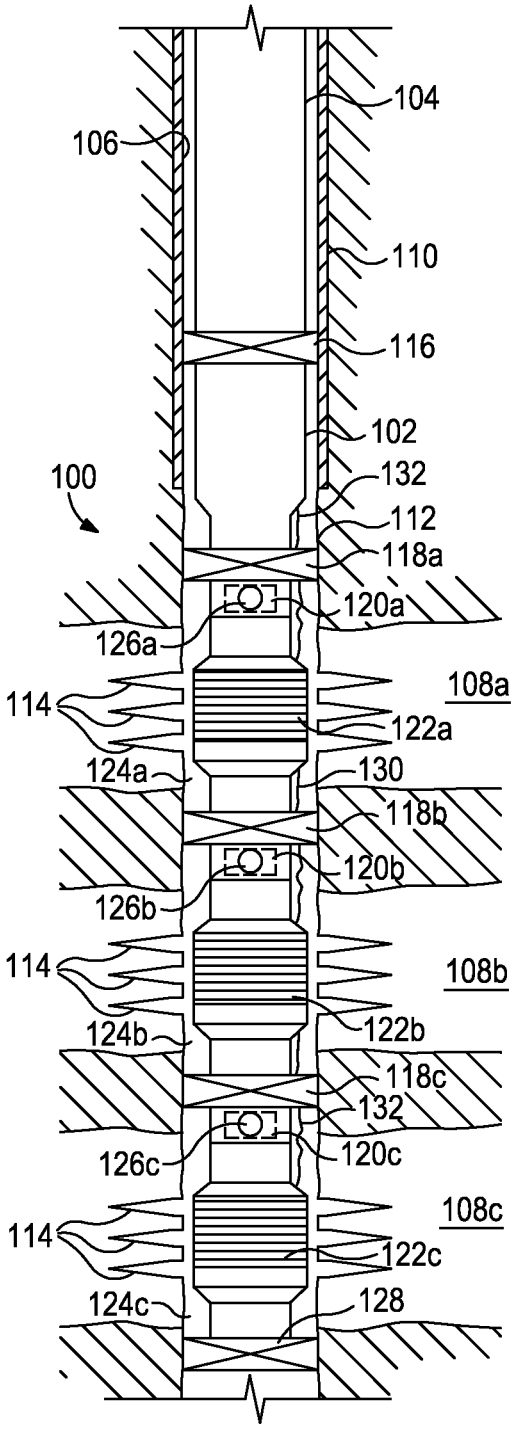
FIG. 1 illustrates an exemplary completion system that may employ the principles of the present disclosure, according to one or more embodiments.

Referring to FIG. 1, illustrated is an exemplary completion system 100 that may employ the principles of the present disclosure, according to one or more embodiments. As illustrated, the system 100 may include a completion string 102 that may be coupled to a work string 104 configured to extend longitudinally within a wellbore 106. The wellbore 106 may penetrate multiple subterranean formation zones 108*a*, 108*b*, and 108*c*, and the completion string 102 may be extended into the wellbore 106 until being arranged or otherwise disposed generally adjacent the formation zones 108*a-c*. The formation zones 108*a-c* may be portions of a common subterranean formation or hydrocarbon-bearing reservoir. Alternatively, one or more of the formation zones 108*a-c* may be portion(s) of separate subterranean formations or hydrocarbon-bearing reservoirs. The term "zone" as used herein, however, is not limited to one type of rock formation or type, but may include several types, without departing from the scope of the disclosure.

The completion string 102 may be deployed within the wellbore 106 and used to hydraulically fracture and gravel pack the various formation zones 108*a-c*, and subsequently regulate hydrocarbon production from each production interval or formation zone 108*a-c*. Although only three formation zones 108*a-c* are depicted in FIG. 1, it will be appreciated that any number of formation zones 108*a-c* may be treated or otherwise serviced using the completion system 100. For instance, while the completion system 100 is depicted as being arranged to treat multiple zones 108*a-c*, it is also contemplated to position a variation of the completion system 100 at a single zone, without departing from the scope of the disclosure.

As depicted in FIG. 1, portions of the wellbore 106 may be lined with casing 110 and cemented therein, as known in the art. The remaining portions of the wellbore 106, including the portions encompassing the formation zones 108*a-c*, may form part of an open hole section 112 of the wellbore 106 and the completion string 102 may be configured to be generally arranged therein during operation. In other embodiments, however, the casing 110 may extend further into the wellbore 106 and otherwise encompass one or more of the formation zones 108*a-c*, without departing from the scope of the disclosure.

Several perforations 114 may be initiated at or in each formation zone 108*a-c* and configured to provide fluid communication between each respective formation zone 108*a-c* and the annulus 124*a-c* (shown as a first annulus 124*a*, a second annulus 124*b*, and a third annulus 124*c*) formed between the completion string 102 and walls of the open hole section 112. Particularly, a first annulus 124*a* may be generally defined between the first formation zone 108*a* and the completion string 102. Second and third annuli 124*b* and 124*c* may similarly be defined between the second and third formation zones 108*b* and 108*c*, respectively, and the completion string 102. In embodiments where the casing 110 extends across the formation zones 108*a-c*, the casing 110 may also be perforated to allow fluid flow into each annulus 124*a-c*.

The completion string 102 may include a top packer 116 including slips (not shown) configured to support the completion string 102 within the casing 110 when properly deployed. In some embodiments, the top packer 116 may be a VERSA-TRIEVE® hangar packer commercially available from Halliburton Energy Services of Houston, Tex., USA. Disposed below the top packer 116 may be one or more isolation packers 118 (three shown as packers 118*a*, 118*b*, and 118*c*) and a sump packer 128, which cooperatively define individual production intervals corresponding to the various formation zones 108*a-c* between adjacent packers 118*a-c* and 128.

One or more circulating sleeves 120 (three shown in phantom as circulating sleeves 120*a*, 120*b*, and 120*c*) and one or more sand screens 122 (three shown as sand screens 122*a*, 122*b*, and 122*c*) may be arranged in each production interval. Each circulating sleeve 120*a-c* may be movably arranged within the completion string 102 and, as will be discussed below, may be configured to axially translate between open and closed positions and a permanently closed or fixed position. First, second, and third circulation ports 126*a*, 126*b*, and 126*c* may be defined in the completion string 102 at the first, second, and third circulating sleeves 120*a-c*, respectively. When the circulating sleeves 120*a-c* are moved into their respective open positions, the circulation ports 126*a-c* are exposed and may thereby provide fluid communication between the interior of the completion string 102 and the corresponding annuli 124*a-c*.

A service tool (not visible in FIG. 1), also known as a gravel pack service tool or a completion service tool, may be extended from a surface location and arranged within the completion string 102 to regulate the gravel packing and hydraulic fracturing processes of each zone 108*a-c*. As will be discussed below, the service tool may include one or more shifting tools (not shown) used to open and close the circulating sleeves 120*a-c*. The service tool may also include a valve (not shown) that helps facilitate the introduction of a gravel pack within each annulus 124*a-c* and also facilitate the hydraulic fracturing process through the corresponding circulation ports 126*a-c*.

In some embodiments, the completion system 100 may further include one or more control lines 130 (one shown) extending externally along the completion string 102 and within each annulus 124*a-c*. The isolation packers 118*a-c* may include or otherwise be configured for control line bypass, which allows the control line 132 to pass therethrough external to the completion string 102. The control line 132 may be representative of or otherwise include one or more electrical lines, one or more fiber optic lines, and/or one or more hydraulic lines used to actuate various downhole tools or otherwise report various fluid properties and well environment parameters within each annulus 124*a-c* during both the gravel packing and fracking operations.

Even though FIG. 1 depicts a vertical well, it will be appreciated by those skilled in the art that the principles of the present disclosure are equally well-suited for use in deviated wells, inclined wells, or horizontal wells. Additionally, even though FIG. 1 has been described with reference to a fracking and gravel packing operation, it should be noted that the principles of the present disclosure are equally well-suited for use in a variety of treatment operations where it is desirable to selectively move the circulating sleeves 120*a-c* between open and closed positions and permanently lock them in place.

Figure 2A:
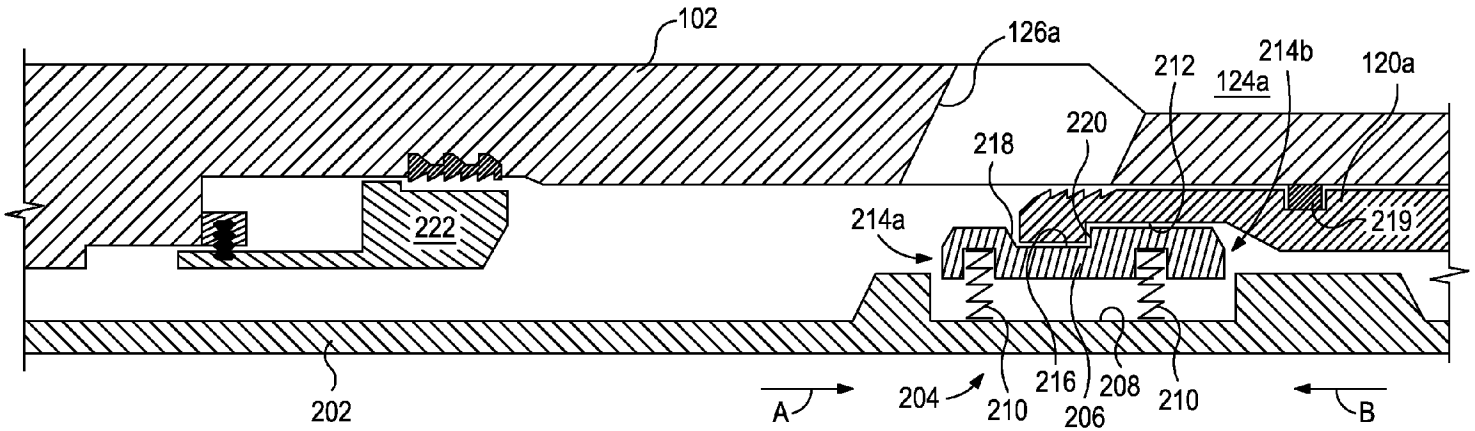
FIGS. 2A-2C illustrate progressive cross-sectional views of an exemplary service tool, according to one or more embodiments.
Figure 2B:
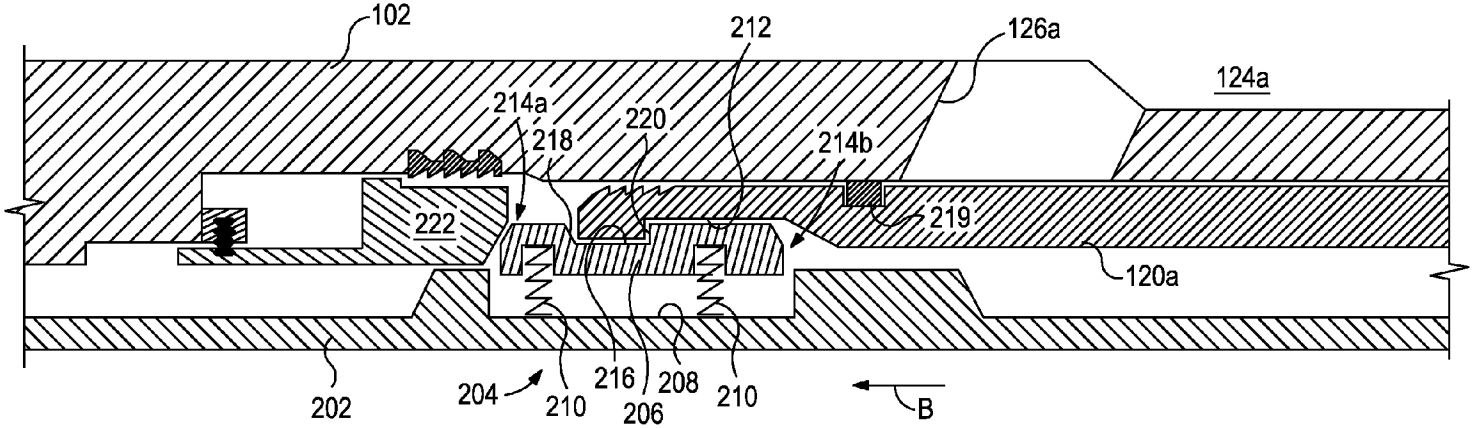
Figure 2C:
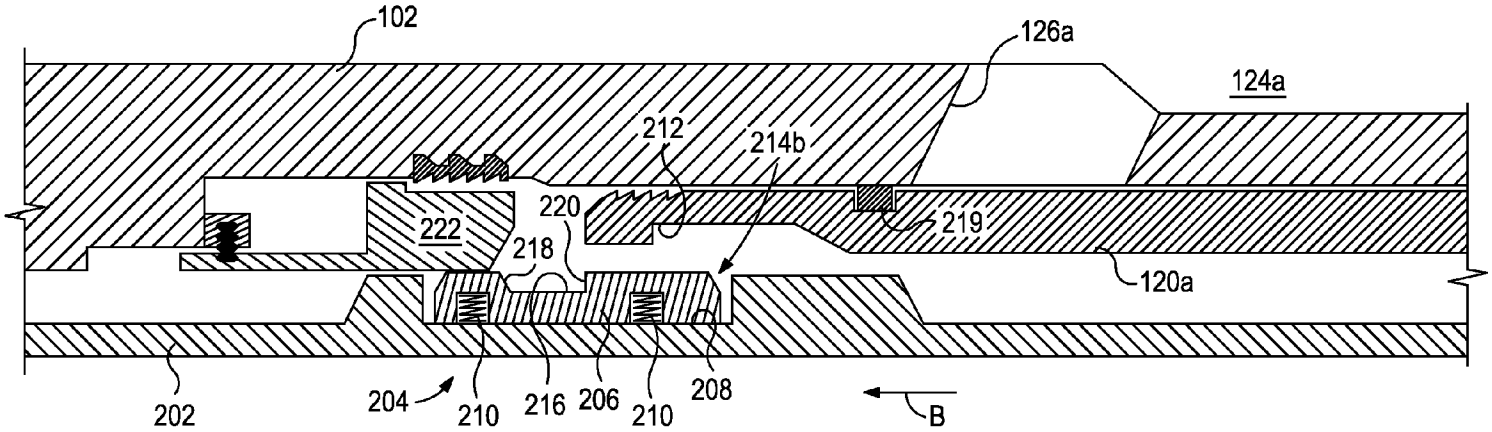

Referring now to FIGS. 2A-2C, with continued reference to FIG. 1, illustrated are progressive cross-sectional views of an exemplary service tool 202, according to one or more embodiments. The service tool 202 is depicted as being generally arranged within the completion string 102 and may be configured to manipulate the axial position of the first circulating sleeve 120*a* to thereby open or occlude the first circulation port 126*a*. While the service tool 202 is depicted as generally interacting with the first circulating sleeve 120*a*, those skilled in the art will readily appreciate that the service tool 202 may equally interact with any of the other circulating sleeves 120*a-c* of FIG. 1, or all of them, without departing from the scope of the disclosure.

As illustrated, the service tool 202 may include a first shifting tool 204 operatively coupled to the service tool 202 or otherwise forming an integral part thereof. The shifting tool 204 may include one or more shifting keys 206 (one shown) arranged within a groove 208 defined in the service tool 202. The shifting key 206 may be radially supported within the groove 208 using one or more biasing devices 210, such as helical compression springs or the like. When not radially constrained, the biasing devices 210 may be configured to urge the shifting key 206 radially outward in order to engage and otherwise interact with the circulating sleeve 120*a*. The circulating sleeve 120*a* may define or otherwise provide a shifting profile 212 configured to mate with the shifting keys 206. As depicted, the shifting profile 212 may be defined on an inner radial surface of the circulating sleeve 120*a*.

The shifting key 206 may include or provide a first or uphole axial end 214*a* and a second or downhole axial end 214*b*. At least a portion of the first and second axial ends 214*a,b* may be beveled or otherwise chamfered in order to ease transition of the shifting tool 204 past axial and/or radial obstructions within the completion string 102, including the circulating sleeve 120*a*, when needed. The shifting key 206 may further include or provide a central channel 216 defined between the first and second axial ends 214*a,b*. The central channel 216 may be configured to receive a portion of the circulating sleeve 120*a* therein or otherwise mate with the shifting profile 212 when the shifting key 206 locates the shifting profile 212. Similar to the first and second axial ends 214*a,b*, an uphole shoulder 218 of the central channel 216 may be beveled or chamfered in order to ease transition of the shifting tool 204 past axial and/or radial obstructions within the completion string 102 when needed, including the portion of the circulating sleeve 120*a* configured to be received therein.

In FIG. 2A, the circulating sleeve 120*a* is depicted in a first or open position, where the circulating port 126*a* is uncovered and thereby able to provide fluid communication between the interior of the completion string 102 and the surrounding annulus 124*a*. A sealing element 219 may be arranged between the completion string 102 and the circulating sleeve 120*a* and configured to provide a sealed interface as the circulating sleeve 120*a* is shifted axially and while it remains stationary.

In some embodiments, the shifting tool 204 may first be extended past the circulating sleeve 120*a* in a first or downhole direction, as indicated by the arrow A, and then retrieved uphole in a second direction, as indicated by the arrow B, in order to locate the shifting profile 212. More particularly, the beveled surfaces of the second axial end 214*b* and the uphole shoulder 218 may allow the shifting tool 204 to bypass the shifting profile 212 of the circulating sleeve 120*a* in the first direction A. Upon encountering the proximal end of the circulating sleeve 120*a*, the beveled surfaces may help the shifting key 206 flex radially inward into the groove 208 against the spring force of the biasing devices 210, and thereby allow the shifting key 206 to axially traverse such axial and/or radial obstructions.

Upon moving back uphole in the second direction B, however, the shifting key 206 may be configured to locate and engage the shifting profile 212 of the circulating sleeve 120*a*. The beveled surface of the first axial end 214*a* of the shifting key 206 may help the shifting key 206 axially traverse any axial obstructions, including the proximal end of the circulating sleeve 120*a*. Once the shifting key 206 has successfully located the shifting profile 212, an axial load in the second direction B may be transferred to the circulating sleeve 120*a* at a downhole shoulder 220 of the central channel 216 in order to move the circulating sleeve 120*a*.

In FIG. 2B, the circulating sleeve 120*a* is depicted in a second or closed position, where the circulating sleeve 120*a* occludes the circulating port 126*a* and thereby prevents fluid communication between the interior of the completion string 102 and the surrounding annulus 124*a*. In some embodiments, the shifting tool 204 may be moved in the second direction B until the first axial end 214*a* of the shifting key 206 engages or otherwise comes into contact with a release shoulder 222 arranged within the completion string 102 uphole from the circulating port 126*a*. The release shoulder 222 will be described in more detail with respect to FIGS. 3A-3C below.

Upon engaging the release shoulder 222, the beveled surface of the first axial end 214*a* may help the shifting key 206 flex radially inward against the spring force of the biasing devices 210, and thereby allow the shifting tool 204 to axially traverse the release shoulder 222 therebelow. This is shown in FIG. 2C, where the shifting tool 204 has move further uphole in the second direction B such that the shifting key 206 has been moved radially inward and at least partially beneath the release shoulder 222. To accomplish this, the biasing devices 210 are compressed with the shifting key 206 until the shifting key 208 is seated within the groove 208. The built up spring force of the biasing devices 210 may be released once the shifting key 206 is moved out of radial engagement with the release shoulder 222. Accordingly, the first shifting tool 204 may be resettable and therefore configured to axial traverse the completion string 102 and close the circulating sleeve 120*a* multiple times during a single run-in downhole.

Figure 3A:
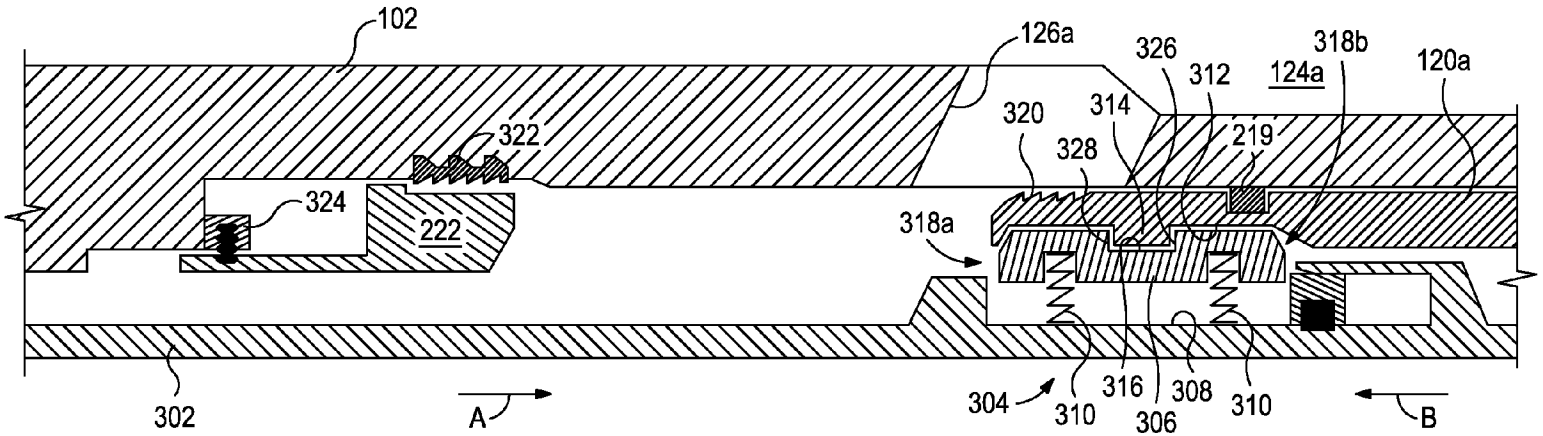
FIGS. 3A-3C illustrate progressive cross-sectional views of another exemplary service tool, according to one or more embodiments.
Figure 3B:
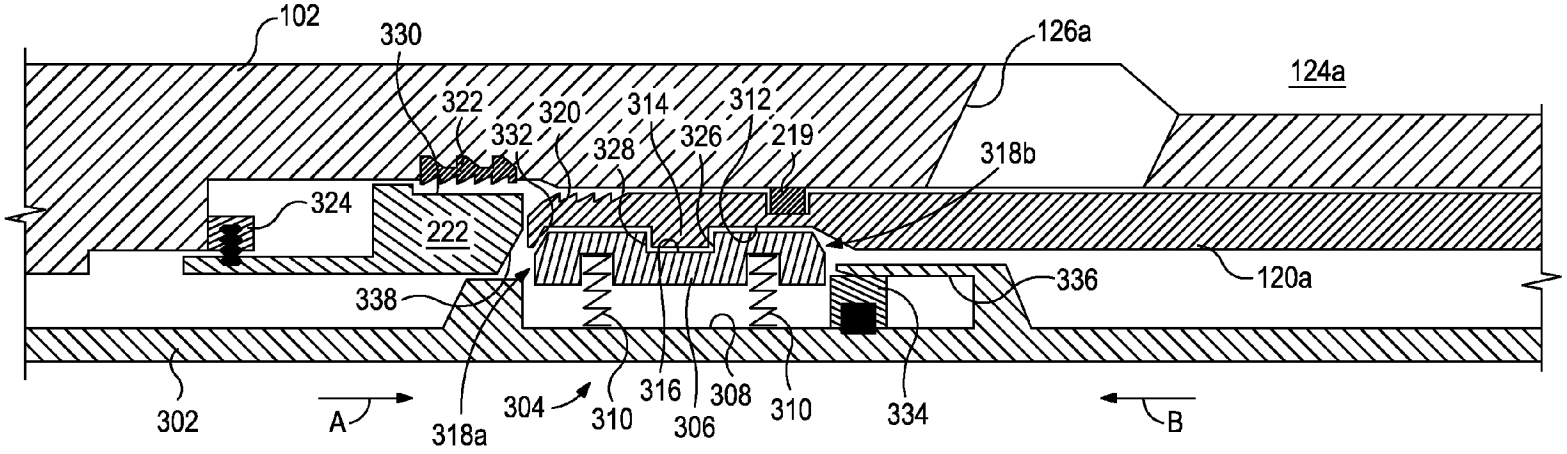
Figure 3C:
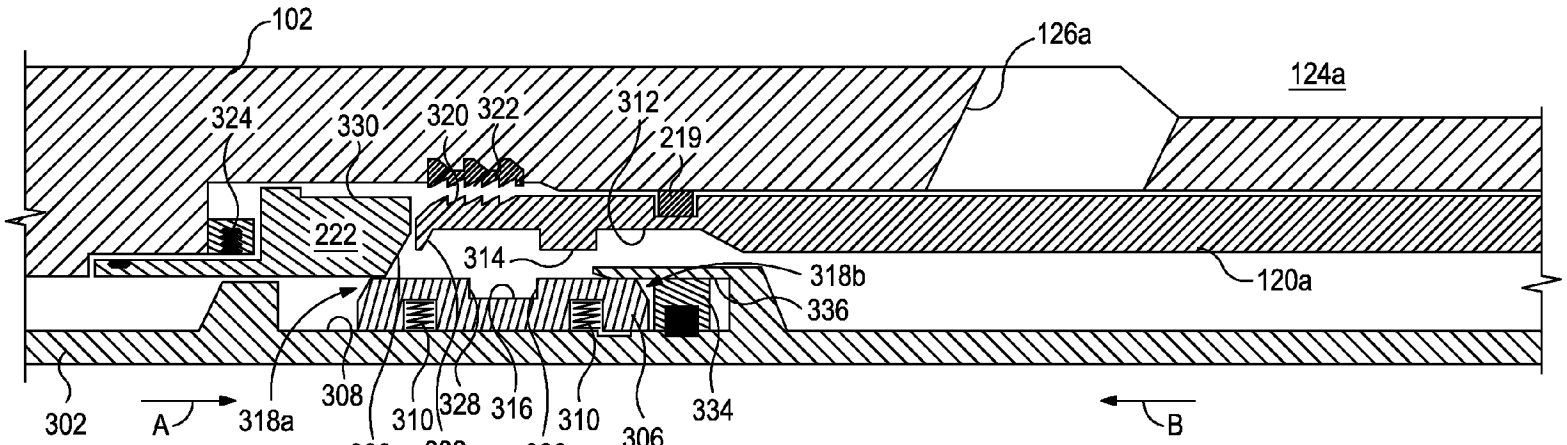

Referring now to FIGS. 3A-3C, with continued reference to FIGS. 1 and 2A-2C, illustrated are progressive cross-sectional views of another exemplary service tool 302, according to one or more embodiments. The service tool 302 may be similar in some respects to the service tool 202 of FIGS. 2A-2C, and therefore may be best understood with reference thereto, where like numerals represent like elements not described again. As illustrated, the service tool 302 may include a second shifting tool 304 operatively coupled to the service tool 302 or otherwise forming an integral part thereof. In some embodiments, the service tools 202 and 302 may be the same service tool and the first shifting tool 204 of FIGS. 2A-2C may be included in the service tool 302 and axially-offset from the second shifting tool 304, without departing from the scope of the disclosure.

The shifting tool 304 may include one or more shifting keys 306 (one shown) arranged within a groove 308 defined in the service tool 302. The shifting key 306 may be radially supported within the groove 308 using one or more biasing devices 310, such as helical compression springs or the like. The biasing devices 310 may be configured to urge the shifting key 206 radially outward in order to engage and otherwise interact with the circulating sleeve 120*a*.

The circulating sleeve 120*a* may define or otherwise provide a selective shifting profile 312 configured to mate with the shifting keys 306. As illustrated, the selective shifting profile 312 may include or otherwise define a radial protrusion 314 that extends radially from the inner radial surface of the circulating sleeve 120*a*. The radial protrusion 314 may be configured to be received into a central channel 316 defined in the shifting key 306. Advantageously, the selective shifting profile 312 may be designed and otherwise configured to mate with the shifting keys 306 of the shifting tool 304 and with no other shifting tool unless similarly designed. Accordingly, other shifting tools may bypass and otherwise not locate the selective shifting profile 312 for axial movement of the circulating sleeve 120*a*.

The shifting key 306 may have a first or uphole axial end 318*a* and a second or downhole axial end 318*b*. Similar to the first and second axial ends 214*a,b* of the first shifting tool 204, at least a portion of the first and second axial ends 318*a,b* may be beveled or otherwise chamfered in order to ease transition of the shifting tool 304 past axial and/or radial obstructions within the completion string 102, including the circulating sleeve 120*a*. The central channel 316 may be defined between the first and second axial ends 318*a,b* and sized to receive the radial protrusion 314 upon locating the selective shifting profile 312.

The circulating sleeve 120*a* may include a locking profile 320 defined on an outer radial surface thereof. The locking profile 320 may be, for example, a series of threads or grooves. In some embodiments, as depicted, the grooves 320 may be provided at the proximal end of the circulating sleeve 120. In other embodiments, the locking profile 320 may be provided at an intermediate location of the circulating sleeve 120*a*, without departing from the scope of the disclosure. The locking profile 320 may be configured to interact with and otherwise engage a locking mechanism 322 disposed on the inner radial wall of the completion string 102. In some embodiments, the locking mechanism 322 may be a body lock ring configured to receive the locking profile 320 as the circulation sleeve 120*a* moves in the second direction B and thereafter prevent the circulating sleeve 120*a* from axial translation in the first direction A. In other embodiments, the locking mechanism 322 may be a c-ring, or the like, configured to engage a corresponding groove (not shown) defined on the circulating sleeve 120*a*. Accordingly, once the locking mechanism 322 successfully engages the locking profile 320, the circulating sleeve 120*a* may be placed in a permanent closed position, as will be described in more detail below.

The release shoulder 222 may be arranged within the completion string 102 uphole from the circulating port 126*a* and axially secured in place with respect to the completion string 102 using one or more securing devices 324 (one shown). In some embodiments, for example, the securing device 324 may be a shearable device, such as a shear pin, a shear ring, or the like. In other embodiments, however, the securing device 324 may be a spring or other type of biasing device that urges the release shoulder 222 to maintain a predetermined axial position with respect to the completion string 102.

In FIG. 3A, the circulating sleeve 120*a* is depicted in the open position and the shifting tool 304 is shown as having located the selective shifting profile 312 with the shifting key 306. Similar to the shifting tool 204 of FIGS. 2A-2C, the shifting tool 304 may also first be extended past the circulating sleeve 120*a* in the first direction A, and then retrieved uphole in the second direction B in order to locate the selective shifting profile 312. Once successfully locating and engaging the selective shifting profile 312, an axial load applied on the service tool 302 in the second direction B may be transferred to the circulating sleeve 120*a* at the radial protrusion 314 via a downhole shoulder 326 of the central channel 316, thereby moving the circulating sleeve 120*a* in the second direction B.

In FIG. 3B, the circulating sleeve 120*a* is depicted as having moved to the second or closed position, where the circulating sleeve 120*a* occludes the circulating port 126*a* and thereby prevents fluid communication between the interior of the completion string 102 and the surrounding annulus 124*a*. In at least one embodiment, the shifting tool 304 may also be used to re-open the circulating sleeve 120*a* by applying an axial load on the service tool 302 in the first direction A. The axial load in the first direction A may be transferred to the circulating sleeve 120*a* at the radial protrusion 314 via an uphole shoulder 328 defined in the central channel 316, and thereby moving the circulating sleeve 120*a*. Accordingly, the shifting tool 304 may prove advantageous in being able to selectively open and close the circulating sleeve 120*a* multiple times in a single trip downhole.

Once the shifting tool 304 moves the circulating sleeve 120*a* into axial engagement with the release shoulder 222, continued application of the axial load on the service tool 302 in the second direction B results in the shearing or breakage of the securing device 324 that secures the release shoulder 222 against axial movement. For example, a predetermined axial load may be applied on the service tool 302 to shear the securing device 324, where the predetermined axial load corresponds to a break point or shear point for the securing device 324. Again, however, as mentioned above, the securing device 324 may instead be replaced with a spring or other type of biasing device, without departing from the scope of the disclosure. In such embodiments, the spring may be configured to be compressed upon assuming the predetermined axial load as transferred through the release shoulder from the circulation sleeve 120*a*.

Once the securing device 324 is sheared or otherwise allows the release shoulder 222 to axially translate with respect to the completion string 102, continued application of the axial load on the service tool 302 in the second direction B may result in the release shoulder 222 also moving in the second direction B. As the release shoulder 222 moves in the second direction B, the locking mechanism 322 may become exposed and able to engage the locking profile 320 of the circulating sleeve 120*a*. As illustrated, the locking mechanism 322 may be situated within a channel 330 defined by the release shoulder 222, and the channel 330 may occlude or otherwise hide the locking mechanism 322 until the release shoulder 222 is moved.

In FIG. 3C, the circulating sleeve 120*a* is depicted in the permanent closed position. As the release shoulder 222 moves in the second direction B, the locking mechanism 322 may receive the locking profile 320 of the circulating sleeve 120*a*, and thereby permanently lock the circulating sleeve 120*a* in place with respect to the completion string 102. Continued axial load on the service tool 302 in the second direction B may then help the shifting key 306 to flex radially inward against the spring force of the biasing devices 310, and thereby allow the shifting tool 304 to axially traverse the release shoulder 222. More particularly, the beveled surface of the first axial end 318*a* of the shifting key 306 may engage an upper end wall 332 of the shifting profile 312 as the service tool 302 continues in the second direction B. In some embodiments, as depicted, the upper end wall 332 may also be beveled or otherwise chamfered to help facilitate the shifting key 306 slide out of axial engagement with the shifting profile 312.

The shifting tool 304 may further include a securing mechanism 334 generally arranged adjacent a cavity 336 defined in the shifting tool 304 and otherwise forming at least a part of the groove 308. The securing mechanism 334 may be a shear ring or one or more shear pins configured to shear or break upon assuming a predetermined axial load. Engaging the first axial end 318*a* against the upper end wall 332 may transfer the axial load in the second direction B through the shifting key 306 and to the securing mechanism 334. Once a predetermined axial load is assumed, the securing mechanism 334 may shear or otherwise break and thereby allow the shifting key 306 to radially collapse inward and otherwise slide out of radial and axial engagement with the shifting profile 312.

After disengaging from the shifting profile 312, the shifting key 306 may axially engage at least a portion of the release shoulder 222. The beveled first end 318*a* may help the shifting key 306 radially collapse even further into the groove 308 as axially forced against the release shoulder 222. In some embodiments, as illustrated, a portion of the distal end 338 of the release shoulder 222 may also be beveled or otherwise chamfered to help the shifting key 306 slide out of axial engagement with the release shoulder 222. As the shifting key 306 radially collapses into the groove 308, and with the securing mechanism 334 no longer secured, the shifting key 306 may be configured to extend into or otherwise be inserted within the cavity 336. The beveled second end 318*b* of the shifting key 306 may help the shifting key 306 slide into the cavity 336 axially as the service tool 302 continues to move in the second direction B. Once in the cavity 336, the shifting key 306 may be secured therein until the shifting tool 304 is returned to the surface.

In other embodiments, the securing mechanism 334 may be replaced with a spring or other type of biasing device that acts to urge the shifting key 306 out of the cavity 336 and otherwise maintain its axial position within the groove 308. In such embodiments, the shifting key 306 may radially collapse into the groove 308 and compress the spring as it axially enters the cavity 336. After axially traversing the release shoulder 222 and other radial obstructions in the second direction B, the shifting tool 304 may be urged back out of the cavity 336 with the spring. Moreover, once past the release shoulder 222 and other radial obstructions, the biasing devices 310 may be configured to radially expand the shifting key 306. As will be appreciated, the second shifting tool 304 in such an embodiment may be resettable and therefore configured to axial traverse the completion string 102 and open and close the circulating sleeve 120*a* multiple times, and also permanently close multiple circulating sleeves during a single run-in downhole.

Figure 4A:
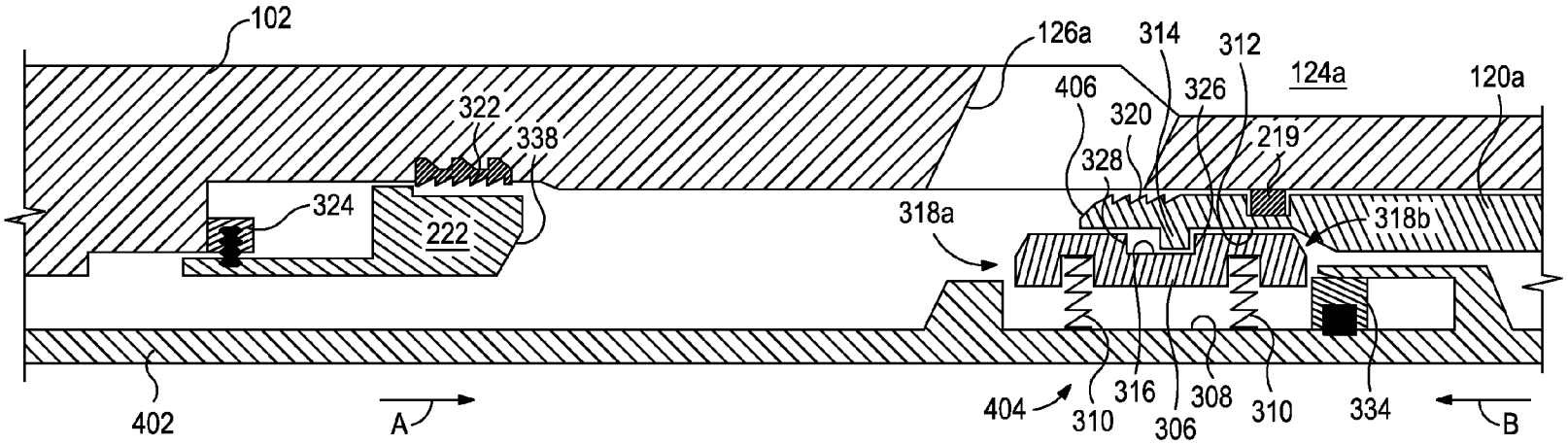
FIGS. 4A-4C illustrate progressive cross-sectional views of another exemplary service tool, according to one or more embodiments.
Figure 4B:
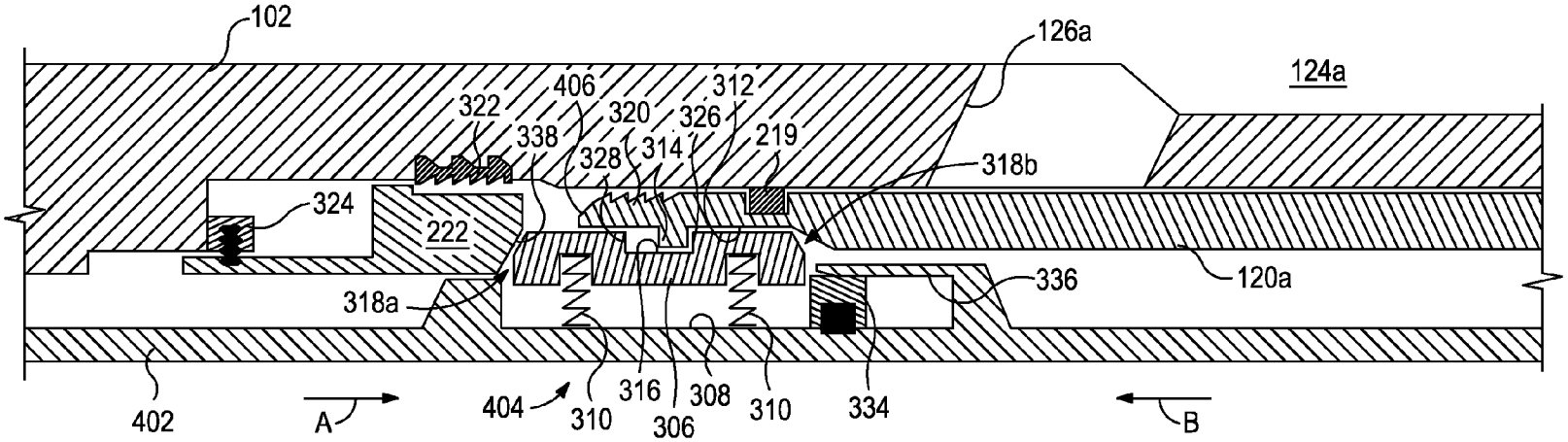
Figure 4C:
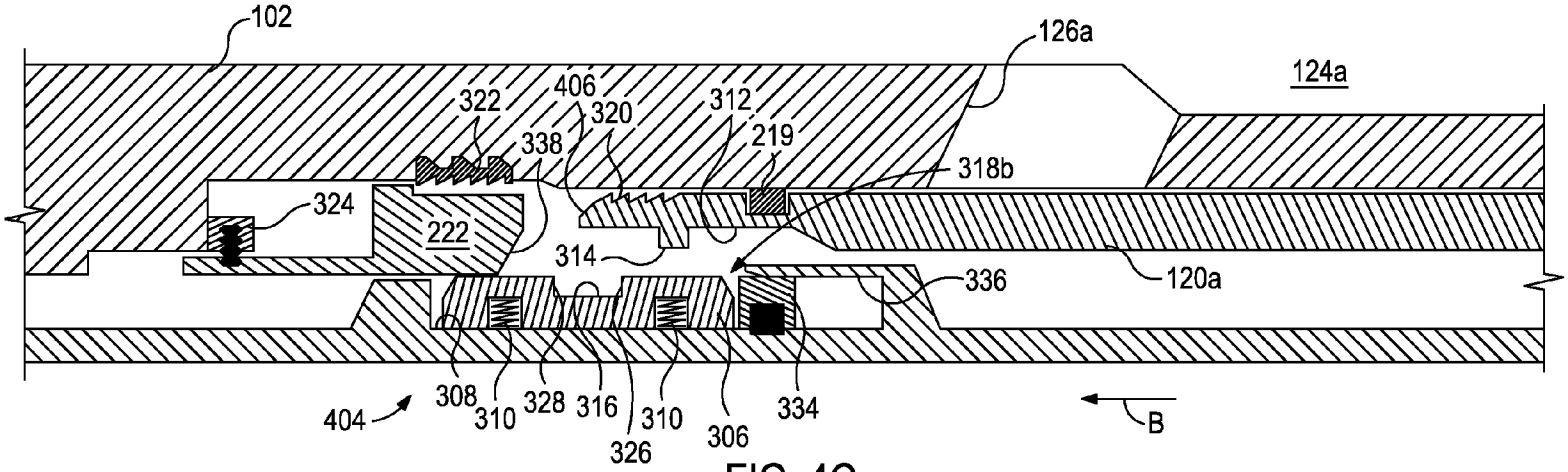

Referring now to FIGS. 4A-4C, with continued reference to FIGS. 3A-3C, illustrated are progressive cross-sectional views of another exemplary service tool 402, according to one or more embodiments. The service tool 402 may be substantially similar to the service tool 302 of FIGS. 3A-3C, and therefore may be best understood with reference thereto, where like numerals represent like elements not described again. As illustrated, the service tool 402 may include a third shifting tool 404 operatively coupled to the service tool 402 or otherwise forming an integral part thereof. In some embodiments, the service tools 202 (FIGS. 2A-2C), 302 (FIGS. 3A-3C), and 402 may be the same and the first and second shifting tools 204 and 304 of FIGS. 2A-2C and 3A-3C, respectively, may be included in or otherwise form part of the service tool 402 as axially offset from the third shifting tool 404, without departing from the scope of the disclosure.

The third shifting tool 404 may be a variation of the second shifting tool 304 of FIGS. 3A-3C. At least one difference between the second and third shifting tools 304, 404, however, is that the central channel 316 of the shifting keys 306 (one shown) may be enlarged axially such that the downhole shoulder 326 may be axially spaced further from the uphole shoulder 328 as opposed to the central channel of the second shifting tool 304. As a result, the radial protrusion 314 may be able to axially shift a short distance within the central channel 316 before engaging either shoulder 326, 328.

Moreover, the selective shifting profile 312 of the circulating sleeve 120*a* in FIGS. 4A-4C may be slightly different than the selective shifting profile 312 of the circulating sleeve 120*a* in FIGS. 3A-3C. More specifically, and in conjunction with the enlarged central channel 316, the first end 318*a* of the shifting key 306 may be able to extend past the proximal end 406 of the circulating sleeve 120*a*, thereby providing a variation of the selective shifting profile 312 of FIGS. 3A-3C. Again, the selective shifting profile 312 may be configured to mate with the shifting keys 306 of the shifting tool 404 and any other similarly designed shifting keys. Accordingly, differently configured or designed shifting tools may bypass the selective shifting profile 312 without locating the shifting profile 312 for axial movement of the circulating sleeve 120*a*.

In FIG. 4A, the circulating sleeve 120*a* is depicted in the open position and the shifting tool 404 is shown as having located the selective shifting profile 312 with the shifting key 306. An axial load may be applied on the service tool 402 in the second direction B and the axial load may be transferred to the circulating sleeve 120*a* at the radial protrusion 314 via the downhole shoulder 326, thereby correspondingly moving the circulating sleeve 120*a* in the second direction B to the closed position. In at least one embodiment, the shifting tool 404 may also be used to re-open the circulating sleeve 120*a* by applying an axial load on the service tool 402 in the first direction A. The axial load in the first direction A may be transferred to the circulating sleeve 120*a* at the radial protrusion 314 via the uphole shoulder 328, and thereby moving the circulating sleeve 120*a*. Accordingly, the shifting tool 404 may be able to selectively open and close the circulating sleeve 120*a* multiple times in a single trip downhole.

In FIG. 4B, the circulating sleeve 120*a* is depicted in the second or closed position, where the circulating sleeve 120*a* has occluded the circulating port 126*a* and thereby preventing fluid communication between the interior of the completion string 102 and the surrounding annulus 124*a*. Since the shifting key 306 extends past the proximal end 406 of the circulating sleeve 120*a*, the shifting tool 404 may be moved in the second direction B until the first axial end 318*a* of the shifting key 306 engages or otherwise comes into contact with the release shoulder 222. Continued axial load on the service tool 402 in the second direction B may then force the shifting key 306 flex radially inward against the spring force of the biasing devices 310, and thereby allow the shifting tool 404 to axially traverse the release shoulder 222 without shearing the securing device 324 that axially secures release shoulder 222.

The beveled surface of the first axial end 318*a* of the shifting key 306 may engage the release shoulder 222 and radially collapse beneath the release shoulder 222 as the service tool 402 continues in the second direction B. The beveled portion of the distal end 338 of the release shoulder 222 may help the shifting key 306 slide out of axial engagement with the release shoulder 222 and collapse radially into the groove 308.

In FIG. 4C, the shifting key 306 is shown as being radially collapsed or contracted into the groove 308 and otherwise able to axially traverse the release shoulder 222 therebelow. In the present embodiment, the securing mechanism 334 may not be sheared or otherwise broken in order to have the shifting key 306 pass below the release shoulder 222. Instead, the securing mechanism 334 may remain intact until the shifting tool 404 possibly encounters another circulating sleeve having a different shifting profile that requires the shifting key 306 to shear the securing mechanism 334 in order to axially traverse a radial obstruction. In such embodiments, another release shoulder (not shown) may be axially moved in order to permanently lock the other circulating sleeve in the closed position, as generally described above.

Figure 5:
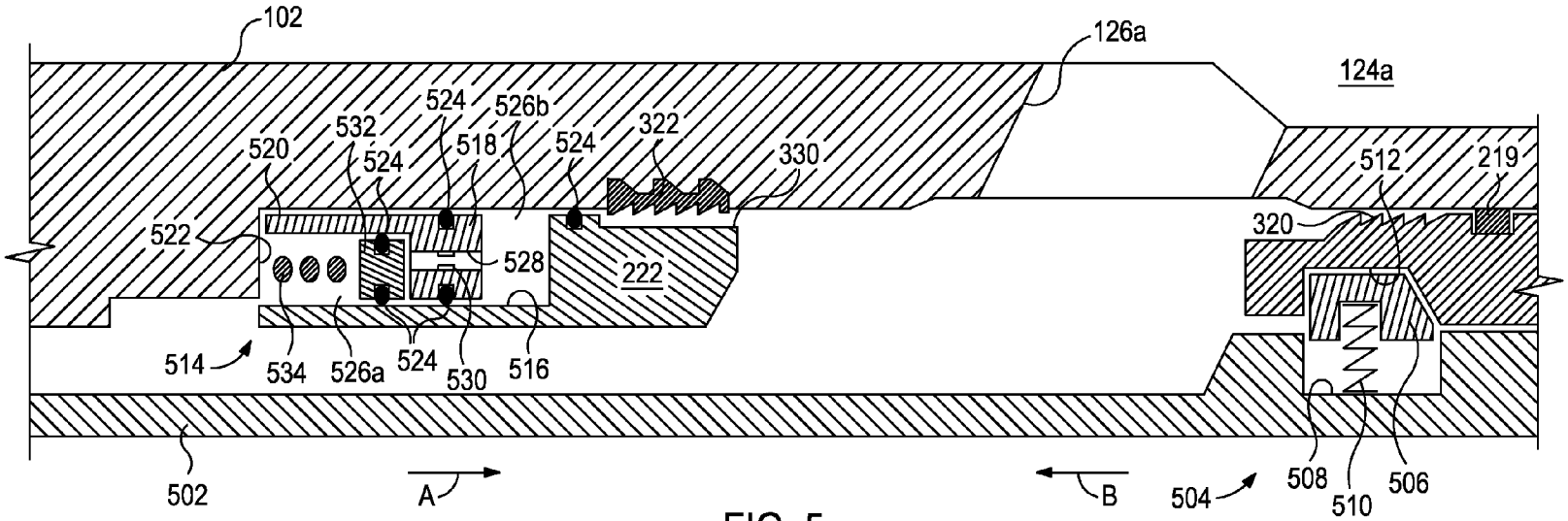
FIG. 5 illustrates a cross-sectional view of another exemplary service tool, according to one or more embodiments.

Referring now to FIG. 5, with continued reference to the preceding figures, illustrated is a cross-sectional view of another service tool 502, according to one or more embodiments. The service tool 502 may be similar in some respects to the services tools 202, 302, and 402 described above. Like numerals used in prior figures that are used in FIG. 5 correspond to like elements or components not described again in detail. As illustrated, the service tool 502 may include a shifting tool 504 operatively coupled to the service tool 502 or otherwise forming an integral part thereof. The shifting tool 504 may include one or more shifting keys 506 (one shown) arranged within a groove 508 defined in the service tool 502. The shifting key 506 may be radially supported within the groove 508 using one or more biasing devices 510 (one shown) configured to urge the shifting key 506 radially outward in order to engage and otherwise mate with a shifting profile 512 provided or otherwise defined by the circulating sleeve 120*a*.

An exemplary release shoulder assembly 514 is depicted in FIG. 5 and includes the release shoulder 222 as being associated therewith. As part of the release shoulder assembly 514, the completion string 102 and the release shoulder 222 may cooperatively provide or otherwise define a hydraulic chamber 516, and a pressure block 518 may be arranged within the hydraulic chamber 516. The pressure block 518 may be generally secured against axial movement with respect to the completion string 102. In some embodiments, for example, a leg 520 may extend longitudinally from the pressure block 518 and engage an upper end wall 522 of the hydraulic chamber 516. In other embodiments, the leg 520 may be omitted and instead replaced with snap rings (not shown) arranged on either axial end of the block 518, or one of said snap rings may be alternatively replaced with a radial shoulder that biases one axial end of the pressure block 518. In yet other embodiments, the pressure block 518 may instead be threaded to the completion string 102 to prevent its axial movement, without departing from the scope of the disclosure.

One or more inner and outer sealing elements 524 may be included on the pressure block 518 and configured to provide a hydraulic seal such that hydraulic fluids are unable to migrate in either axial direction past the pressure block 518 at the interfaces of the pressure block 518 with the completion string 102 and the release shoulder 522. The sealing elements 524 may be O-rings, for example, or another type or design of elastomeric sealing element known to those skilled in the art. As depicted, one or more additional sealing elements 524 (one shown) may also be provided at the interface between the release shoulder 222 and the completion string 102 such that a dynamic seal is provided at the interface when the release shoulder 222 is axially moved with respect to the completion string 102.

The pressure block 518 generally separates or divides the hydraulic chamber 516 into an upper chamber 526*a* and a lower chamber 526*b*, and controls a flow of hydraulic fluid between the upper and lower chambers 526*a,b*. To accomplish this, the pressure block 518 may define or otherwise provide a fluid conduit 528 that extends through the pressure block 518 and thereby places the upper and lower chambers 526*a,b* in fluid communication. In some embodiments, a fluid metering valve 530 may be arranged within the fluid conduit 528 and may be configured to control the flow of hydraulic fluid between the upper and lower chambers 516*a,b* via the fluid conduit 528. The fluid metering valve 530 may be, for example, a restriction or a check valve that allows a metered amount of hydraulic fluid to bypass the pressure block 518 at a predetermined flow rate determined by the parameters of the fluid metering valve 530.

While virtually any incompressible fluid may be used as the hydraulic fluid in the release shoulder assembly 514, in accordance with the present disclosure, one suitable hydraulic fluid that may be used is high-grade automatic transmission fluid (ATF), available at any automotive parts retailer. However, other hydraulic fluids may be used, such as oils or silicon fluids and the like, which are known and used by those of ordinary skill in the art.

The release shoulder assembly 514 may further include a floating piston 532 and a biasing device 534 arranged in the upper chamber 526*a* of the hydraulic chamber 516. Similar to the pressure block 518, the floating piston 532 may include one or more inner and outer sealing elements 524 configured to provide a hydraulic seal such that hydraulic fluids are unable to migrate in either axial direction past the floating piston 532. The biasing device 534, which may be a helical compression spring or the like, may interpose the upper end wall 522 and the floating piston 532 and generally urge the floating piston 532 toward the pressure block 518 with a predetermined spring force.

In exemplary operation, the shifting tool 504 may locate the shifting profile 512 of the circulating sleeve 120*a*, as illustrated, and an axial load applied on the service tool 502 in the second direction B may serve to close the circulating sleeve 120*a* and otherwise bring the circulating sleeve 120*a* into axial contact with the release shoulder 222. Continued application of the axial load in the second direction B may begin to force hydraulic fluid present within the lower chamber 526*b* to flow through the fluid conduit 528 to the upper chamber 526*a* at a steady flow rate. As will be appreciated, the time and axial load required to move the releasing shoulder 222 will depend on the size and length of the fluid conduit 528 and the parameters of the fluid metering valve 530 (if used). As the hydraulic fluid enters the upper chamber 526*a*, the floating piston 532 may be forced axially against the biasing device 534 toward the upper end wall 522, thereby compressing the biasing device 534 and otherwise building up spring force therein.

The steady rate of flow through the fluid conduit 528 translates into a steady and predictable rate of movement of the release shoulder 222 in the second direction B, thereby gradually exposing the locking mechanism 322 encompassed by the channel 330. As a result, an operator may be able to approximately gauge how much time is required to move the release shoulder 222 so that the locking profile 320 may successfully engage the locking mechanism 322 and permanently lock the circulating sleeve 120*a* in the closed position. Consequently, the axial load in the second direction B may be applied for a predetermined period of time until enough hydraulic fluid had passed from the lower chamber 526*b* to the upper chamber 526*a*, thereby allowing the locking mechanism 322 to permanently lock the circulating sleeve 120*a* in place.

In some embodiments, it may not be desired to permanently lock the circulating sleeve 120*a* in the closed position, but instead only axially move the release shoulder 222 a short distance (e.g., not enough to engage the locking mechanism 322 with the locking profile 320). In such embodiments, the axial load applied on the service tool 502 in the second direction B may be reduced, removed, or otherwise changed into an axial load in the first direction A prior to the locking mechanism 322 engaging the locking profile 320. Without the circulating sleeve 120*a* forcing the release shoulder 222 in the second direction B, the spring force of the biasing device 534 may be released and otherwise urge the floating piston 532 back toward the pressure block 528. As the floating piston 532 moves back toward the pressure block 528, the hydraulic fluid within upper chamber 526*a* steadily flows into the lower chamber 526*b* via the fluid conduit 528. As a result, the release shoulder 222 may be re-set and hide or occlude the locking mechanism 322 once again. As will be appreciated, the re-setting capability of the release shoulder assembly 514 may prove useful when a shifting tool needs to axially bypass the release shoulder 222 and in the process moves the release shoulder 222 a short distance.

Figure 6A:
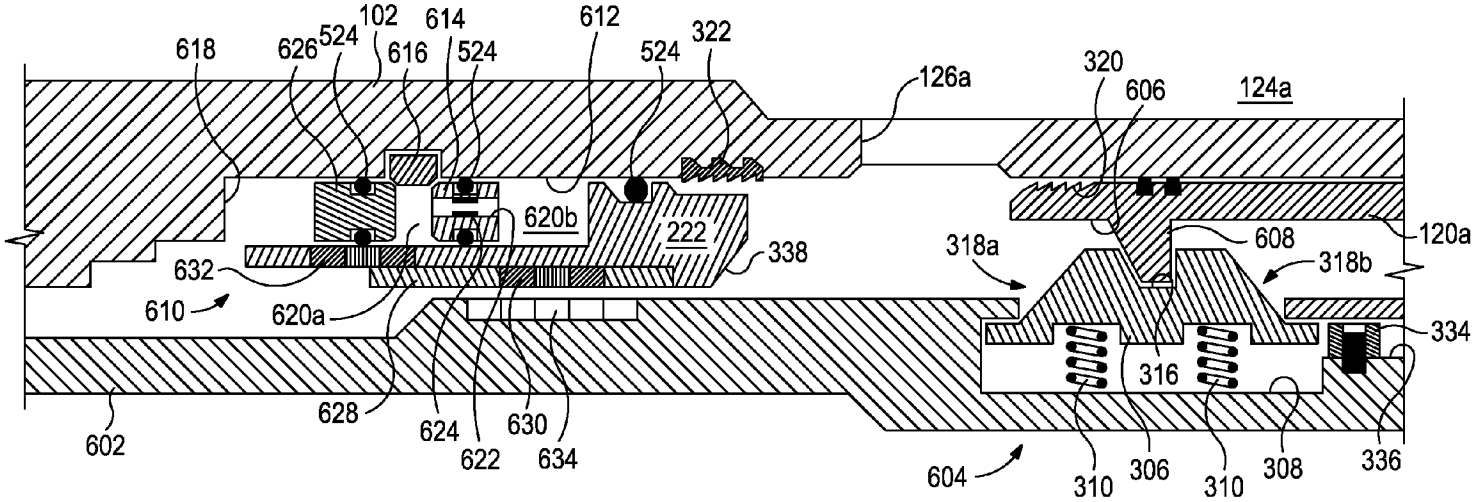
FIGS. 6A and 6B illustrate progressive cross-sectional views of another exemplary service tool, according to one or more embodiments.
Figure 6B:
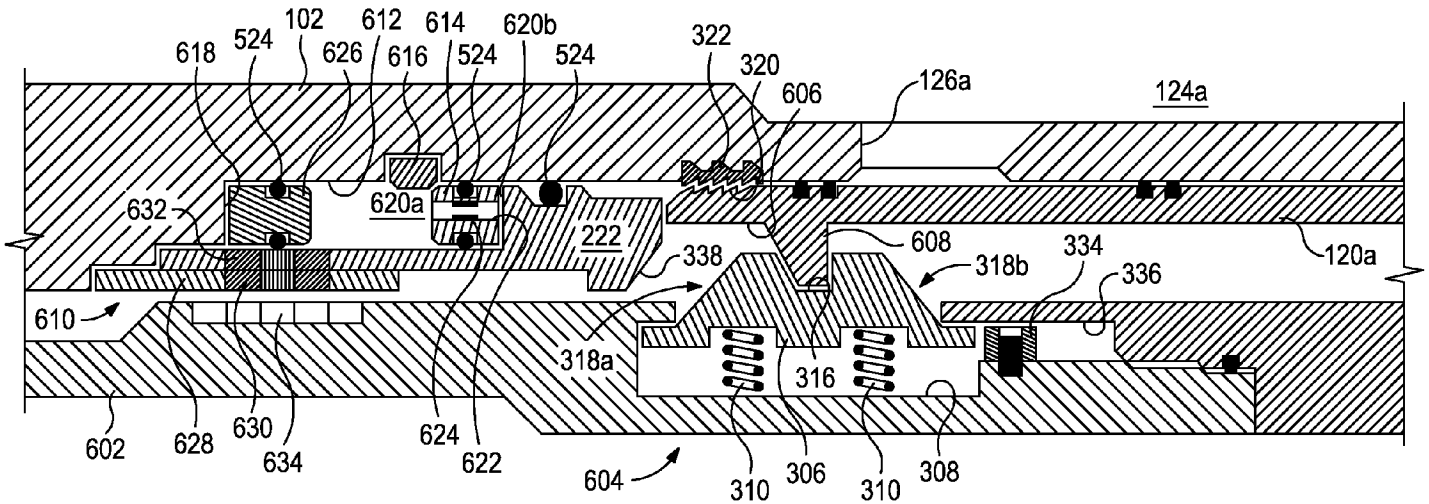

Referring now to FIGS. 6A and 6B, with continued reference to the prior figures, illustrated are progressive cross-sectional views of another exemplary service tool 602, according to one or more embodiments. The service tool 602 may be similar in some respects to the service tools 302 and 502 of FIGS. 3A-3C and 5, respectively, and therefore may be best understood with reference thereto, where like numerals represent like elements not described again. As illustrated, the service tool 602 may include a shifting tool 604 operatively coupled to the service tool 602 or otherwise forming an integral part thereof. As with prior embodiments, the service tools 202 (FIGS. 2A-2C), 302 (FIGS. 3A-3C), 402 (FIGS. 4A-4C), 502 (FIG. 5), and 602 may be one and the same and the shifting tools 204, 304, 404, and 504 described herein may be included in or otherwise form part of the service tool 602 as axially offset from the presently described shifting tool 604, without departing from the scope of the disclosure.

The shifting tool 604 may be substantially similar to the shifting tool 304 of FIGS. 3A-3C, thereby including the one or more shifting keys 306 (one shown) arranged within the groove 308. The shifting keys 306 may be radially supported within the groove 308 using one or more biasing devices 310. The circulating sleeve 120*a* may define or otherwise provide a shifting profile 606 configured to mate with the shifting keys 306. As illustrated, the shifting profile 606 may include or otherwise define a radial protrusion 608 that extends radially from the inner radial surface of the circulating sleeve 120*a*. The radial protrusion 608 may be configured to be received into the central channel 316 defined in the shifting keys 306.

An exemplary release shoulder assembly 610 is depicted in FIGS. 6A and 6B and includes the release shoulder 222 as being associated therewith. A hydraulic chamber 612 may be cooperatively defined by the completion string 102 and the release shoulder 222, and a pressure block 614 may be arranged within the hydraulic chamber 612. The pressure block 614 may be generally secured against axial movement with respect to the completion string 102 in the uphole or second direction B using, for example, a snap ring 616. In other embodiments, the snap ring 616 may be replaced with a radial shoulder or another type of radial profile that prevents the pressure block 614 from moving toward an uphole end wall 618 of the hydraulic chamber 612.

Inner and outer sealing elements 524 may be included on the pressure block 614 and configured to provide a hydraulic seal such that hydraulic fluids within the hydraulic chamber 612 are unable to migrate in either axial direction past the pressure block 614 at the interface of the pressure block 614 with the completion string 102 and the release shoulder 522.

The pressure block 614 generally separates the hydraulic chamber 612 into an upper chamber 620*a* and a lower chamber 620*b*, and controls the flow of hydraulic fluid between the upper and lower chambers 620*a,b*. Similar to the pressure block 518 of FIG. 5, the pressure block 614 may define or otherwise provide a fluid conduit 622 that extends through the pressure block 614 and thereby places the upper and lower chambers 620*a,b* in fluid communication. Moreover, a fluid metering valve 624 similar to the fluid metering valve 530 of FIG. 5 may be arranged within the fluid conduit 622 and configured to control the flow of fluid between the upper and lower chambers 620*a,b* via the fluid conduit 622. A floating piston 626 may be arranged in the upper chamber 620*a* of the hydraulic chamber 612. Inner and outer sealing elements 524 may provide a hydraulic seal such that hydraulic fluids are unable to migrate in either axial direction past the floating piston 626.

The release shoulder assembly 610 may further include a magnetic sleeve 628 axially movable with respect to the release shoulder 222. The magnetic sleeve 628 may include a first or inner set of magnets 630 that is arranged on the magnetic sleeve 628 and therefore configured to move therewith. The inner magnets 630 may be configured to magnetically interact with or otherwise attract a second or outer set of magnets 632 disposed on the release shoulder 222. A third or shifting set of magnets 634 may be arranged on the service tool 602 and configured to magnetically interact with and otherwise attract the inner magnets 630. The inner, outer, and shifting magnets 630, 632, 634 may each be rare earth magnets, for example, samarium-cobalt magnets. While a certain number of magnets are shown in FIGS. 6A-6C for each of the inner, outer, and shifting magnets 630, 632, 634, those skilled in the art will readily appreciate that any number of magnets (including one) may be used for each.

The hydraulic chamber 612 may be filled with a hydraulic fluid that is able to be conveyed between the upper and lower chambers 620*a,b* when the release shoulder 222 moves. More particularly, the fluid in the hydraulic chamber 612 may be any fluid that becomes strongly magnetized in the presence of a magnetic field. For example, the fluid may be a ferromagnetic fluid or a magnetorheological fluid (collectively "ferrofluid"), or any fluid that includes ferrous particles suspended in a carrier fluid. When placed in the presence of a magnetic field, such ferrofluids may exhibit a high viscosity, thereby substantially preventing the fluid from being able to pass through the pressure block 614 via the fluid conduit 622. In the absence of the magnetic field, however, such ferrofluids exhibit a low viscosity, thereby being able to pass through the pressure block 614 via the fluid conduit 622.

In FIG. 6A, the magnetic sleeve 628 is arranged such that the inner magnets 630 magnetically interact with the ferrofluid disposed within the lower chamber 620*b*. In other words, the magnetic field produced by the inner magnets 630 extends radially into the lower chamber 620*b* and thereby magnetizes and otherwise increases the viscosity of the ferrofluid therein. As a result, in such a configuration the ferrofluid is kept in a high viscosity state and therefore substantially prevented from passing through the fluid conduit 622, and thereby maintaining the release shoulder 222 in place axially.

In exemplary operation, the shifting tool 604 may locate the shifting profile 606 of the circulating sleeve 120*a* and an axial load applied on the service tool 602 in the second direction B may begin to move the circulating sleeve 120*a* to the closed position. The shifting magnets 634 arranged on the service tool 602 may locate and magnetically couple to the inner magnets 630 as the service tool 602 continues in the second direction B, thereby correspondingly shifting or otherwise moving the magnetic sleeve 628 in the second direction B. As will be appreciated, the shifting magnets 634 may couple to the inner magnets 630 before, during, or after the shifting tool 604 locates the shifting profile 612.

In FIG. 6B, the circulating sleeve 120*a* is depicted in the permanent closed position. To accomplish this, the service tool 602 is moved in the second direction B until the proximal end of the circulating sleeve 120*a* is brought into axial contact with the release shoulder 222. The magnetic sleeve 628 may also correspondingly move or shift in the second direction B until the inner magnets 630 are moved into a position radially offset from or otherwise axially adjacent to the outer magnets 632. In such a configuration, a closed magnetic circuit may be generated by the inner and outer magnets 630, 632, such that the magnetic field produced by the inner magnets 630 may become substantially choked and otherwise unable to interact with the ferrofluid in the hydraulic chamber 612. As a result, the viscosity of the ferrofluid dramatically decreases, thereby enabling the ferrofluid to pass through the fluid conduit 622 if required.

Accordingly, continued application of the axial load in the second direction B on the circulating sleeve 120*a* as engaged with the release shoulder 222 may begin to force the ferrofluid present within the lower chamber 620*b* to flow through the fluid conduit 622 and into the upper chamber 620*a* at a steady flow rate. As will be appreciated, the time and axial load required to move the releasing shoulder 222 will depend on the size and length of the fluid conduit 622, the parameters of the fluid metering valve 624 (if used), and/or the fluid properties of the ferrofluid. As the ferrofluid enters the upper chamber 620*a*, the floating piston 626 may be moved toward the upper end wall 618 to accommodate the influx of fluid.

The steady rate of flow translates into a steady and predictable rate of movement of the release shoulder 222 in the second direction B, thereby gradually exposing the locking mechanism 322 encompassed by the channel 330. As a result, an operator may be able to approximately gauge how much time is required to move the release shoulder 222 so that the locking profile 320 may engage the locking mechanism 322 and permanently lock the circulating sleeve 120*a* in the closed position. Consequently, the axial load in the second direction B may be applied for a predetermined period of time until enough ferrofluid had passed from the lower chamber 620*b* to the upper chamber 620*a*, thereby allowing the locking mechanism 322 to lock the circulating sleeve 120*a* in place.

Continued axial load on the service tool 602 in the second direction B may then help the shifting key 306 to flex radially inward against the spring force of the biasing devices 310, and thereby allow the shifting tool 604 to axially traverse the release shoulder 222. More particularly, continued axial load on the service tool 602 in the second direction B may transfer the axial load to the second axial end 318*b* of the shifting key as secured to the circulating sleeve 120*a* at the radial protrusion 608. The second axial end 318*b* may then engage and shear the securing mechanism 334 upon assuming a predetermined axial load, thereby allowing the shifting keys 306 to radially collapse inward and otherwise slide out of radial and axial engagement with the shifting profile 606.

As the shifting key 306 radially collapses into the groove 308, and with the securing mechanism 334 no longer secured, the shifting key 306 may be configured to extend into or otherwise be inserted within the cavity 336. The beveled second end 318*b* of the shifting key 306 may help the shifting key 306 slide or shift into the cavity 336 axially. As the service tool 602 continues to move in the second direction B, the first axial end 318*a* of the shifting keys 306 may axially engage at least a portion of the release shoulder 222. The beveled first end 318*a* may help the shifting key 306 radially collapse even further into the groove 308 as axially forced against the release shoulder 222. In some embodiments, as illustrated, a portion of the distal end 338 of the release shoulder 222 may also be beveled or otherwise chamfered to help the shifting key 306 slide out of axial engagement with the release shoulder 222.

In other embodiments, as with prior embodiments, the securing mechanism 334 may be replaced with a spring or other type of biasing device that acts to urge the shifting key 306 out of the cavity 336 and otherwise maintain its axial position within the groove 308. In such embodiments, the shifting key 306 may radially collapse into the groove 308 and compress the spring as it axially enters the cavity 336. After axially traversing the release shoulder 222 and other radial obstructions in the second direction B, the shifting tool 604 may be urged back out of the cavity 336 with the spring. Moreover, once past the release shoulder 222 and other radial obstructions, the biasing devices 310 may be configured to radially expand the shifting key 306. Accordingly, the shifting tool 604 in such an embodiment may be resettable and therefore configured to axial traverse the completion string 102 and open and close the circulating sleeve 120*a* multiple times, and also permanently close multiple circulating sleeves during a single run-in downhole.

Embodiments disclosed herein include:

A. A completion system that may include a completion string having a circulating sleeve movably arranged therein, the circulating sleeve having a locking profile defined on an outer radial surface thereof and a shifting profile defined on an inner radial surface thereof, a service tool configured to be arranged at least partially within the completion string and including a shifting tool having one or more shifting keys configured to mate with the shifting profile, wherein, when the shifting keys locate and mate with the shifting profile, an axial load applied on the service tool axially moves the circulating sleeve, and a release shoulder assembly arranged within the completion string and comprising a release shoulder that defines a channel configured to receive a locking mechanism disposed on the completion string, the locking mechanism being occluded within the channel until the release shoulder is moved axially, thereby allowing the locking mechanism to engage the locking profile and secure the circulating sleeve in a permanent closed position.

B. A method that may include introducing a service tool at least partially into a completion string, the service tool including a shifting tool having one or more shifting keys and the completion string providing a circulating sleeve movably arranged therein, wherein the circulating sleeve has a locking profile defined on an outer radial surface thereof and a shifting profile defined on an inner radial surface thereof, mating the one or more shifting keys with the shifting profile, applying an axial load on the service tool in a first direction to move the circulating sleeve to a closed position, engaging the circulating sleeve on a release shoulder of a release shoulder assembly arranged within the completion string, the release shoulder defining a channel configured to receive and occlude a locking mechanism disposed on the completion string, axially moving the release shoulder in the first direction with the axial load applied on the service tool and the circulating sleeve and thereby exposing the locking mechanism, and engaging the locking profile on the locking mechanism and thereby securing the circulating sleeve in a permanent closed position.

Each of embodiments A and B may have one or more of the following additional elements in any combination: Element 1: wherein the shifting tool is a first shifting tool and the service tool includes a second shifting tool axially offset from the first shifting tool. Element 2: wherein the shifting tool is configured to move the circulating sleeve between an open position, where one or more circulation ports defined in the completion string are exposed, and a closed position, where the circulating sleeve occludes the one or more circulation ports. Element 3: wherein each shifting key has a beveled first axial end configured to urge the one or more shifting keys radially inward upon axially engaging the release shoulder and thereby allowing the shifting tool to axially traverse the release shoulder. Element 4: wherein the locking mechanism is a body lock ring configured to receive and secure the locking profile. Element 5: wherein the release shoulder assembly further comprises one or more securing devices configured to axially secure the release shoulder with respect to the completion string. Element 6: wherein the one or more securing devices are devices selected from the group consisting of a shear pin, a shear ring, and a spring. Element 7: wherein the release shoulder assembly further comprises a hydraulic chamber cooperatively defined by the completion string and the release shoulder, a pressure block arranged within the hydraulic chamber and dividing the hydraulic chamber into an upper chamber and a lower chamber, the pressure block having a fluid conduit defined therethrough that places the upper and lower chambers in fluid communication, and a floating piston arranged in the upper chamber. Element 8: further comprising a fluid metering valve arranged within the fluid conduit and configured to meter the flow of hydraulic fluid between the upper and lower chambers via the fluid conduit. Element 9: further comprising a biasing device arranged in the upper chamber and interposing an upper end wall of the hydraulic chamber and the floating piston, the biasing device being configured to urge the floating piston toward the pressure block. Element 10: wherein the hydraulic fluid is a ferrofluid and the release shoulder assembly further comprises a magnetic sleeve axially movable with respect to the release shoulder and having a first set of magnets disposed thereon, a second set of magnets disposed on the release shoulder, and a third set of magnets arranged on the service tool and configured to magnetically attract the first set of magnets in response to the axial load and thereby axially move the magnetic sleeve such that the first set of magnets are brought into magnetic interaction with the second set of magnets, wherein, when the first set of magnets are arranged adjacent the lower chamber, a magnetic field produced by the first set of magnets prevents the ferrofluid from passing through the fluid conduit, and wherein, when the first set of magnets magnetically interact with the second set of magnets, a closed magnetic circuit is generated, thereby enabling the ferrofluid to pass through the fluid conduit.

Element 11: wherein engaging the circulating sleeve on the release shoulder is preceded by applying an axial load on the service tool in a second direction opposite the first direction and thereby moving the circulating sleeve back to an open position where one or more circulation ports defined in the completion string are exposed. Element 12: wherein each shifting key has a beveled first axial end, the method further comprising engaging the beveled first axial end of each shifting key against the release shoulder, and urging the one or more shifting keys radially inward and thereby allowing the shifting tool to axially traverse the release shoulder. Element 13: wherein the release shoulder assembly further comprises one or more securing devices that axially secure the release shoulder with respect to the completion string, the method further comprising shearing the one or more securing devices as the axial load is transferred to the release shoulder from the circulating sleeve. Element 14: wherein the release shoulder assembly further comprises a hydraulic chamber cooperatively defined by the completion string and the release shoulder, and a pressure block arranged within the hydraulic chamber and dividing the hydraulic chamber into an upper chamber and a lower chamber, and wherein axially moving the release shoulder in the first direction further comprises flowing hydraulic fluid from the lower chamber to the upper chamber through a fluid conduit defined in the pressure block, and axially displacing a floating piston in arranged in the upper chamber with the hydraulic fluid entering the upper chamber. Element 15: further comprising metering a flow of the hydraulic fluid through the fluid conduit with a fluid metering valve arranged within the fluid conduit, and gradually exposing the locking mechanism at a rate corresponding to a flow rate of the hydraulic fluid through the fluid conduit. Element 16: wherein the release shoulder assembly further comprises a biasing device arranged in the upper chamber and interposing an upper end wall of the hydraulic chamber and the floating piston, the method further comprising engaging and compressing the biasing device with the with the floating piston as the floating piston is displaced by the hydraulic fluid, releasing the axial load in the first direction, allowing the biasing device to expand, and forcing the hydraulic fluid to flow back into the lower chamber via the fluid conduit with the floating piston as the biasing device expands. Element 17: wherein the hydraulic fluid is a ferrofluid and the release shoulder assembly further comprises a magnetic sleeve axially movable with respect to the release shoulder and having a first set of magnets disposed thereon, a second set of magnets disposed on the release shoulder, and a third set of magnets arranged on the service tool, the method further comprising generating a magnetic field that extends into the lower chamber with the first set of magnets and thereby preventing the ferrofluid from passing through the fluid conduit. Element 18: further comprising magnetically attracting the first set of magnets with the third set of magnets as the service tool moves in the first direction, axially moving the magnetic sleeve in the first direction with the third set of magnets magnetically attracted to the first set of magnets, placing the first set of magnets in magnetic interaction with the second set of magnets, and generating a closed magnetic circuit when the first set of magnets magnetically interact with the second set of magnets, and thereby enabling the ferrofluid to pass through the fluid conduit. Element 19: further comprising metering a flow of the ferrofluid through the fluid conduit with a fluid metering valve arranged within the fluid conduit, and gradually exposing the locking mechanism at a rate corresponding to a flow rate of the ferrofluid through the fluid conduit.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A completion system, comprising:

a completion string having a circulating sleeve movably arranged therein, the circulating sleeve having a locking profile defined on an outer radial surface thereof and a shifting profile defined on an inner radial surface thereof;

a service tool configured to be arranged at least partially within the completion string and including a shifting tool having one or more shifting keys configured to mate with the shifting profile, wherein, when the shifting keys locate and mate with the shifting profile, an axial load applied on the service tool axially moves the circulating sleeve; and a release shoulder assembly arranged within the completion string and comprising a release shoulder that defines a channel configured to receive a locking mechanism disposed on the completion string, the locking mechanism being occluded within the channel until the release shoulder is moved axially, thereby allowing the locking mechanism to engage the locking profile and secure the circulating sleeve in a permanent closed position.

2. The completion system of claim 1, wherein the shifting tool is a first shifting tool and the service tool includes a second shifting tool axially offset from the first shifting tool.

3. The completion system of claim 1, wherein the shifting tool is configured to move the circulating sleeve between an open position, where one or more circulation ports defined in the completion string are exposed, and a closed position, where the circulating sleeve occludes the one or more circulation ports.

4. The completion system of claim 1, wherein each shifting key has a beveled first axial end configured to urge the one or more shifting keys radially inward upon axially engaging the release shoulder and thereby allowing the shifting tool to axially traverse the release shoulder.

5. The completion system of claim 1, wherein the locking mechanism is a body lock ring configured to receive and secure the locking profile.

6. The completion system of claim 1, wherein the release shoulder assembly further comprises one or more securing devices configured to axially secure the release shoulder with respect to the completion string.

7. The completion system of claim 6, wherein the one or more securing devices are devices selected from the group consisting of a shear pin, a shear ring, and a spring.

8. The completion system of claim 1, wherein the release shoulder assembly further comprises:

a hydraulic chamber cooperatively defined by the completion string and the release shoulder;

a pressure block arranged within the hydraulic chamber and dividing the hydraulic chamber into an upper chamber and a lower chamber, the pressure block having a fluid conduit defined therethrough that places the upper and lower chambers in fluid communication; and a floating piston arranged in the upper chamber.

9. The completion system of claim 8, further comprising a fluid metering valve arranged within the fluid conduit and configured to meter the flow of hydraulic fluid between the upper and lower chambers via the fluid conduit.

10. The completion system of claim 8, further comprising a biasing device arranged in the upper chamber and interposing an upper end wall of the hydraulic chamber and the floating piston, the biasing device being configured to urge the floating piston toward the pressure block.

11. The completion system of claim 8, wherein the hydraulic fluid is a ferrofluid and the release shoulder assembly further comprises:

a magnetic sleeve axially movable with respect to the release shoulder and having a first set of magnets disposed thereon;

a second set of magnets disposed on the release shoulder; and a third set of magnets arranged on the service tool and configured to magnetically attract the first set of magnets in response to the axial load and thereby axially move the magnetic sleeve such that the first set of magnets are brought into magnetic interaction with the second set of magnets, wherein, when the first set of magnets are arranged adjacent the lower chamber, a magnetic field produced by the first set of magnets prevents the ferrofluid from passing through the fluid conduit, and wherein, when the first set of magnets magnetically interact with the second set of magnets, a closed magnetic circuit is generated, thereby enabling the ferrofluid to pass through the fluid conduit.

12. A method, comprising:

introducing a service tool at least partially into a completion string, the service tool including a shifting tool having one or more shifting keys and the completion string providing a circulating sleeve movably arranged therein, wherein the circulating sleeve has a locking profile defined on an outer radial surface thereof and a shifting profile defined on an inner radial surface thereof;

mating the one or more shifting keys with the shifting profile;

applying an axial load on the service tool in a first direction to move the circulating sleeve to a closed position;

engaging the circulating sleeve on a release shoulder of a release shoulder assembly arranged within the completion string, the release shoulder defining a channel configured to receive and occlude a locking mechanism disposed on the completion string;

axially moving the release shoulder in the first direction with the axial load applied on the service tool and the circulating sleeve and thereby exposing the locking mechanism; and engaging the locking profile on the locking mechanism and thereby securing the circulating sleeve in a permanent closed position.

13. The method of claim 12, wherein engaging the circulating sleeve on the release shoulder is preceded by applying an axial load on the service tool in a second direction opposite the first direction and thereby moving the circulating sleeve back to an open position where one or more circulation ports defined in the completion string are exposed.

14. The method of claim 12, wherein each shifting key has a beveled first axial end, the method further comprising:

engaging the beveled first axial end of each shifting key against the release shoulder; and urging the one or more shifting keys radially inward and thereby allowing the shifting tool to axially traverse the release shoulder.

15. The method of claim 12, wherein the release shoulder assembly further comprises one or more securing devices that axially secure the release shoulder with respect to the completion string, the method further comprising shearing the one or more securing devices as the axial load is transferred to the release shoulder from the circulating sleeve.

16. The method of claim 12, wherein the release shoulder assembly further comprises a hydraulic chamber cooperatively defined by the completion string and the release shoulder, and a pressure block arranged within the hydraulic chamber and dividing the hydraulic chamber into an upper chamber and a lower chamber, and wherein axially moving the release shoulder in the first direction further comprises:

flowing hydraulic fluid from the lower chamber to the upper chamber through a fluid conduit defined in the pressure block; and axially displacing a floating piston in arranged in the upper chamber with the hydraulic fluid entering the upper chamber.

17. The method of claim 16, further comprising:

metering a flow of the hydraulic fluid through the fluid conduit with a fluid metering valve arranged within the fluid conduit; and gradually exposing the locking mechanism at a rate corresponding to a flow rate of the hydraulic fluid through the fluid conduit.

18. The method of claim 16, wherein the release shoulder assembly further comprises a biasing device arranged in the upper chamber and interposing an upper end wall of the hydraulic chamber and the floating piston, the method further comprising:

engaging and compressing the biasing device with the with the floating piston as the floating piston is displaced by the hydraulic fluid;

releasing the axial load in the first direction;

allowing the biasing device to expand; and forcing the hydraulic fluid to flow back into the lower chamber via the fluid conduit with the floating piston as the biasing device expands.

19. The method of claim 16, wherein the hydraulic fluid is a ferrofluid and the release shoulder assembly further comprises a magnetic sleeve axially movable with respect to the release shoulder and having a first set of magnets disposed thereon, a second set of magnets disposed on the release shoulder, and a third set of magnets arranged on the service tool, the method further comprising:

generating a magnetic field that extends into the lower chamber with the first set of magnets and thereby preventing the ferrofluid from passing through the fluid conduit.

20. The method of claim 19, further comprising:

magnetically attracting the first set of magnets with the third set of magnets as the service tool moves in the first direction;

axially moving the magnetic sleeve in the first direction with the third set of magnets magnetically attracted to the first set of magnets;

placing the first set of magnets in magnetic interaction with the second set of magnets; and generating a closed magnetic circuit when the first set of magnets magnetically interact with the second set of magnets, and thereby enabling the ferrofluid to pass through the fluid conduit.

21. The method of claim 20, further comprising:

metering a flow of the ferrofluid through the fluid conduit with a fluid metering valve arranged within the fluid conduit; and gradually exposing the locking mechanism at a rate corresponding to a flow rate of the ferrofluid through the fluid conduit.

* * * * *